US006595129B2

(12) United States Patent
Mori

(10) Patent No.: US 6,595,129 B2
(45) Date of Patent: Jul. 22, 2003

(54) HEAT-SENSITIVE STENCIL, PROCESS OF PREPARING STENCIL PRINTING MASTER AND STENCIL PRINTER

(75) Inventor: Tomiya Mori, Miyagi-ken (JP)

(73) Assignee: Tohoku Ricoh Co., Ltd., Miyagi-ken (JP)

( * ) Notice: Subject to any disclaimer, the term of this patent is extended or adjusted under 35 U.S.C. 154(b) by 0 days.

(21) Appl. No.: 09/918,977

(22) Filed: Jul. 31, 2001

(65) Prior Publication Data

US 2003/0075059 A1 Apr. 24, 2003

(51) Int. Cl.[7] ..... B41N 1/24
(52) U.S. Cl. ..... 101/128.21; 101/128.4
(58) Field of Search ..... 101/127, 128.21, 101/128.4; 428/195

(56) References Cited

U.S. PATENT DOCUMENTS

| | | | | |
|---|---|---|---|---|
| 5,843,560 A | 12/1998 | Ohta et al. | ..... | 101/128.21 |
| 5,908,687 A | 6/1999 | Mori | ..... | 101/128.21 |
| 6,096,374 A | 8/2000 | Ohta et al. | ..... | 427/148 |
| 6,372,332 B1 | 4/2002 | Arai et al. | ..... | 428/195 |

FOREIGN PATENT DOCUMENTS

| | | | |
|---|---|---|---|
| EP | 688681 | * | 12/1995 |
| EP | 1090777 | * | 4/2001 |
| GB | 2332868 | * | 7/1999 |
| JP | 10024667 | | 1/1998 |
| JP | 10147075 | | 6/1998 |
| JP | 10236011 | | 9/1998 |
| JP | 2000-177265 | * | 6/2000 |
| JP | 2001-63239 | * | 3/2001 |
| JP | 2001171252 | | 6/2001 |

* cited by examiner

*Primary Examiner*—Stephen R. Funk
(74) *Attorney, Agent, or Firm*—Cooper & Dunham LLP

(57) ABSTRACT

A heat-sensitive stencil including a thermoplastic resin film on which a porous resin layer, a water soluble resin layer and a fibrous porous layer are formed in succession. A thin resin layer may be disposed between the thermoplastic resin film and the porous resin layer.

19 Claims, 2 Drawing Sheets

HEAT-SENSITIVE STENCIL, PROCESS OF PREPARING STENCIL PRINTING MASTER AND STENCIL PRINTER

BACKGROUND OF THE INVENTION

This invention relates to a heat-sensitive stencil, to a process of preparing a stencil printing master and to a stencil printer using the heat-sensitive stencil.

One known heat-sensitive stencil is composed of an ink-permeable thin paper serving as an ink port and a thermoplastic resin film bonded with an adhesive to the port. The stencil is heated imagewise by, for example, a thermal head to perforate the heated portions of the thermoplastic resin film, thereby obtaining a printing master for reproducing images by mimeographic printing. The conventional stencil, however, poses problems because (1) the adhesive tends to be accumulated in interstices between fibers to form "fins" which prevent the thermal perforation during the master forming step and the passage of an ink during the printing step, (2) the fibers per se prevent smooth passage of an ink and (3) the paper port is relatively expensive.

To cope with the above problems, JP-A-54-33117 proposes a stencil-having no paper port and composed stantially only of a thermoplastic resin film. While this stencil can completely solve the above-mentioned problems, a new serious problem arises; i.e. it is necessary to significantly increase the thickness of the stencil in order to obtain satisfactory stiffness required for transferring the stencil master during printing stage. An increase of the thickness results in the lowering of the thermal sensitivity.

U.S. Pat. No. 5,843,560 discloses a heat-sensitive stencil having a porous resin layer formed on a thermoplastic resin film. This stencil has been found to be able to solve the above-described problems but to cause a problem because of insufficient tensile strength.

JP-A-H10-147075 discloses a heat-sensitive stencil having a porous fibrous layer over a surface of a porous resin layer. The fibrous layer has been found to improve the tensile strength of the stencil but to adversely affect the print image quality.

SUMMARY OF THE INVENTION

It is an object of the present invention to provide a heat-sensitive stencil which has a high stiffness, a high tensile strength and gives a high quality print.

Another object of the present invention is to provide a heat-sensitive stencil of the above-mentioned type which can exhibit a high resistance to inter-layer delamination.

In accomplishing the foregoing objects, there is provided in accordance with one aspect of the present invention a heat-sensitive stencil which comprises a thermoplastic resin film, a porous resin layer provided on said thermoplastic resin film, an ink permeable, water soluble resin layer provided on said porous resin layer, and a fibrous porous layer provided on said water soluble resin layer.

In another aspect, the present invention provides a heat-sensitive stencil which comprises a thermoplastic resin film, a porous resin layer provided on said thermoplastic resin film, a fibrous porous layer provided on said water soluble resin layer, a thin resin layer provided between said thermoplastic resin film and said porous resin layer, and imagewise perforations provided in said stencil and each having an area of at least D $\mu$m, wherein said porous resin layer has pores exposed to a surface thereof to form a multiplicity of openings, wherein the total area of said openings is Y% of the area of said surface, and wherein D and Y have the following relationship:

$$D=(61-Y)/0.0063.$$

BRIEF DESCRIPTION OF THE DRAWINGS

Other objects, features and advantages of the present invention will become apparent from the detailed description of the preferred embodiments of the invention which follows, when considered in light of the accompanying drawings, in which.

DETAILED DESCRIPTION OF THE PREFERRED EMBODIMENTS OF THE INVENTION

Figure 1:
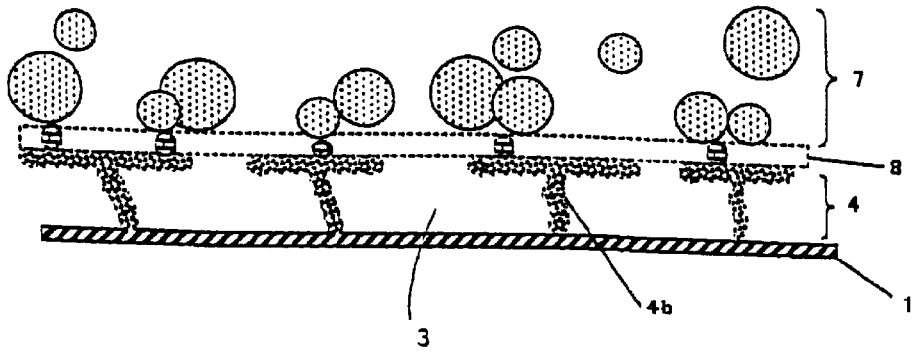
FIG. 1 is a sectional view schematically illustrating one embodiment of a heat-sensitive stencil according to the present invention.

FIG. 1 is a sectional view schematically illustrating one embodiment of a stencil according to the present invention. Designated as 1 is a thermoplastic resin film on which a porous resin layer 4, an ink permeable, water soluble resin layer 8 and a fibrous porous layer 7 are provided in succession in this order.

Any thermoplastic resin conventionally used in heat-sensitive stencil master may be used for the film 1. Illustrative of suitable thermoplastic resins are vinyl chloride-vinylidene chloride copolymers, polypropylene and polyesters. A polyester film having melting energy of 3–11 cal/g (JP-A-62-149496), a polyester film having a degree of crystallization of 30% or less (JP-A-62-282983) and a polyester film containing at least 50 mol % of butylene terephthalate units (JP-A-2-158391) are particularly preferred because they permit perforation with a low energy. The thermoplastic resin film 1 preferably has a thickness of 0.5–10 $\mu$m, more preferably 1–7 $\mu$m for reasons of easiness in formation of the porous layer 4 thereon and in formation of perforations.

The resin film 1 may contain one or more additives such as a flame retardant, a heat stabilizing agent, anti-oxidation agent, a UV absorbing agent, a pigment, an extender, a filler, a dye, an organic lubricant, an anti-foaming agent and a slippage improving agent, if desired. The lubricant may be a fatty acid ester or a wax. The slippage improving agent may be inorganic particles, such as clay, mica, titanium oxide, calcium carbonate, kaolin, talc or wet or dry silica, or organic particles, such as particles of polymers having acrylic acid or styrene units. The pigment (or filler) may be, for example, barytes, barium sulfate, barium carbonate, calcium carbonate, kaolin, clay, silica, hydrated silica, talc, basic magnesium carbonate, alumina white, basic lead carbonate, basic lead sulfate, lead sulfate, zinc sulfate and titanium oxide, potassium titanate, potassium borate or titanium oxide. The pigment in the form of whiskers is suitably used.

If desired, the thermoplastic resin layer 1 may be backed by a stick preventing layer (not shown) containing a stick preventing agent such as a silicone mold release agent, a fluorine resin mold release agent or a phosphoric ester surfactant.

Figure 2:
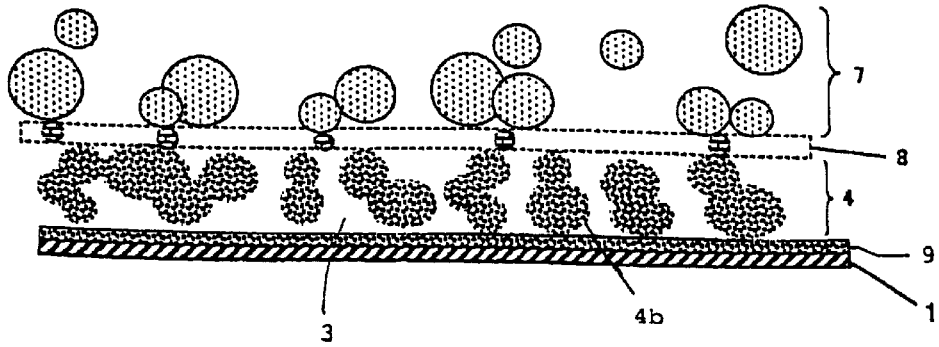
FIGS. 2 and 3 are sectional views, similar to FIG. 1, schematically illustrating other embodiments of heat-sensitive stencils according to the present invention.
Figure 3:
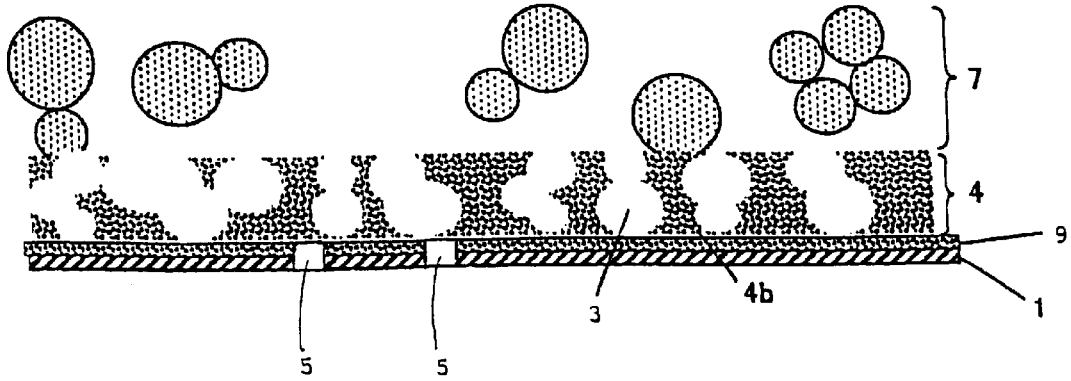
Figure 4:
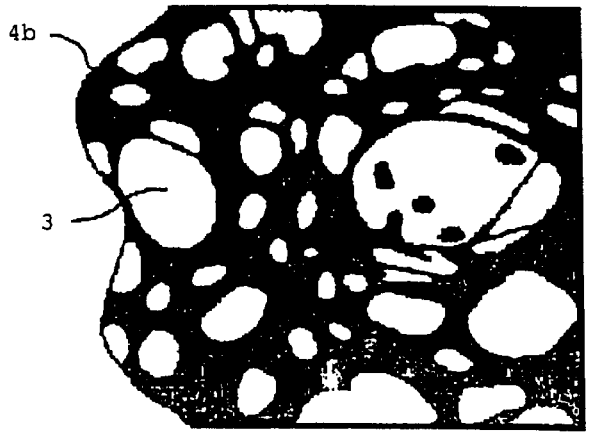
FIG. 4 is an enlarged view schematically illustrating openings in a surface of a heat-sensitive stencil.

The porous resin layer 4, which is non-fibrous, is formed from a solvent solution of a resin by, for example, a method described in U.S. Pat. No. 5,843,560, the disclosure of which, including the specification, claims and drawings, is hereby incorporated by reference herein. The porous resin layer 4 has a multiplicity pores 3 defined by resin walls 4*b*. The shape of the pores 3 is not specifically limited and may be as schematically illustrated in FIGS. 1–3. Thus, the pores 3 may be defined by resin walls 4*b* which are in the form of, for example, columns, spheres, plates of varying shapes. The structure of pores 3 may vary according to the method and condition of preparation of the porous resin layer 4, such as kind of the resin, concentration of the resin solution, kind of the solvent, amount of the resin solution applied, drying temperature, applying temperature and humidity.

Each pore of the porous resin layer 4 preferably opens at a surface of the porous resin layer opposite the thermoplastic resin film 1 for reasons of proper ink permeability through the porous resin layer 4. However, this is not essential. Since a heat-sensitive stencil ink is generally of a water in oil emulsion, closed cells may be broken upon contact with the ink. A mechanical or chemical treatment may be adopted, if necessary, to break closed cells of the porous resin layer 4.

The porous layer 4 preferably has an average pore diameter of 1–50 $\mu$m, more preferably 2–30 $\mu$m, for reasons of proper ink permeability. The average pore diameter may be measured from an electron microphotograph (magnification: 1,000) of the surface of the porous layer 4. The photograph is processed by an image processor (LA-555D manufactured by Pierce Inc.) for determining the diameter of the circle corresponding to the opening.

It is preferred that the total area of the openings of the porous resin layer 4 having an equivalent diameter of at least 5 $\mu$m be 4–80%, more preferably 10–60%, of a total area S of the surface of the porous resin layer 4 for reasons of proper ink passage therethrough and proper capability of the formation of perforations. The term "openings" herein refers to pores 3 exposed to a surface of the layer 4 and the term "equivalent diameter" refers to a diameter of a circle having the same area as that of the corresponding "opening". The total area of the openings may be measured from an electron microphotograph (magnification: 1,000) of the surface of the porous layer 4. The photograph is processed by an image processor (LA-555D manufactured by Pierce Inc.) for determining the diameter of the circle corresponding to the opening.

It is also preferred that the total area of the openings having an equivalent diameter of at least 5 $\mu$m, be at least 50%, more preferably at least 70%, of a total area of the openings for reasons of proper ink passage therethrough and proper capability of the formation of perforations.

The porous resin layer 4 preferably has a thickness of 5–100 $\mu$m, more preferably 6–50 $\mu$m, for reasons of proper stiffness of the stencil and proper ink transference. The density of the porous resin layer 4 is preferably 0.01–1 g/cm , more preferably 0.1–0.5 g/cm$^3$, for reasons of proper stiffness and mechanical strengths. It is also desirous that the thickness of the porous resin layer 4 be uniform.

For reasons of proper transferability of the printing master in the printer, it is preferred that the stencil have a flexural rigidity of at least 5 mN, when measured with a Lorentzen Stiffness Tester.

For reasons of obtaining good print quality, the heat-sensitive stencil according to the present invention preferably shows an air permeability in the range of 1.0 cm$^3$/cm$^2$·sec to 157 cm$^3$/cm$^2$·sec in a portion thereof when the thermoplastic resin film of that portion is perforated to form perforations providing an open ratio SO/SP of at least 0.2, wherein SO represents a total area of the perforations and SP represents the area of the portion. The air permeability of a printing master represents the ink permeability thereof. Thus, an air permeability of a printing master of below 1.0 cm$^3$/cm$^2$·sec means that the porous resin layer has a low porosity and that the master has low ink permeability. On the other hand, an air permeability in excess of 157 cm$^3$/cm$^2$·sec means that the porous resin layer has low ink retentivity and that stains and blurs may be caused.

The air permeability may be measured in the following manner. A square solid pattern (black pattern) with a size of 10×10 cm is read by a printer (PRIPORT VT 3820 manufactured by Ricoh Company, Ltd.) and a sample stencil is perforated with a thermal head in accordance with the read out pattern to form a printing master. The perforation operations are performed for five similar samples so that five printing masters having open ratios SO/SP of about 0.2, 0.35, 0.50, 0.65 and 0.80 are obtained. The open ratio of a master may be measured by making a photomicrograph (magnification: 100) thereof. The photomicrograph is then magnification-copied (magnifying ratio: 200) using a copying machine (IMAGIO MF530 manufactured by Ricoh Company, Ltd.). Perforations shown in the copy are marked on an OHP film and then read by a scanner (300 DPI, 256 gradient). This is binarized with an image retouch software Adobe Photoshop 2.5 J. The open ratio of the perforations is measured using an image analysis software NIH IMAGE. The perforated portion of each of the printing masters is measured for the air permeability thereof by any conventional method. When at least one of the five masters has an air permeability in the range of 1.0 cm$^3$/cm$^2$·sec to 157 cm$^3$/cm$^2$·sec, the stencil is regarded as having the air permeability in the range of 1.0 cm$^3$/cm$^2$·sec to 157 cm$^3$/cm$^2$·sec.

In the state where the stencil has been processed by a thermal head to form perforations in the thermoplastic resin layer 1, it is preferred that part of the porous resin layer 4 in each of the perforations remain unremoved and cover the perforations. The remaining portion of the porous resin layer 4 serves to control the amount of ink transferred from the master to a paper during the mimeographic printing stage. Such remaining portion of the layer 4 can be formed by suitably adjusting the thickness of the layer 4.

Any resin may be used for the formation of the porous layer 4. Illustrative of suitable resins of the porous layer 4 are vinyl resins such as poly(vinyl chloride), poly(vinyl butyral), vinyl chloride-vinyl acetate copolymer, vinyl chloride-vinylidene chloride copolymer or vinyl chloride-acrylonitrile copolymer; polyamide such as nylon; polyolefins such as polyethylene, polypropylene, polybutene and polybutylene; polyphenylene oxide; (meth)acrylic ester; polycarbonate; cellulose derivatives such as acetylcellulose, acetylbutylcellulose or acetylpropylcellulose; polyesters; polyacetal; fluorine resins; polyurethane; natural rubber; thermoplastic elastomers; biodegradable plastics; fatty acids; waxes; proteins; carbohydrates; copolymers thereof and mixtures thereof. It is preferred that the porous resin layer 4 contain a resin capable of softening at such a temperature that the perforation by a thermal head is carried out, generally at a temperature of 150° C. or less, for reasons of facilitating the perforation of the thermoplastic resin film 1.

The porous resin layer may contain one or more additives such as a filler, an antistatic agent, a stick-preventing agent, a surfactant, an antiseptic agent and an antifoaming agent. Addition of a filler including pigments, particles, powder and fibers to the porous resin layer is desirable to control the strength, stiffness and the size of pores thereof. Use of a filler in the form of needles, fibers or plates is particularly preferred. Illustrative of suitable fillers are needle-like natural mineral fillers such as magnesium silicate, sepiolite, potassium titanate, wollastonite, zonolite and gypsum fiber; needle-like, synthetic mineral fillers such as non-oxide-type needle whiskers, oxide whiskers and mixed oxide whiskers; platy fillers such as mica, glass flakes and talc; natural or synthetic fibers such as carbon fiber, polyester fiber, glass fiber, vinylon fiber, nylon fiber and acrylic fiber; and pigments such as organic polymer particles of, for example, poly(vinyl chloride) particles, poly(vinyl acetate) particles and polymethyl acrylate particles, and inorganic particles of, for example, carbon black, zinc oxide, titania, calcium carbonate and silica and microcapsules (e.g. Matsumoto Microsphere). The filler is generally used in an amount of 5–200% based on the weight of the resin of the porous resin layer.

One preferred method of fabricating the above porous resin layer 4 will be next described. A resin for forming the porous resin layer 4 is first dissolved in a mixed solvent including a first solvent (good solvent) capable of dissolving the resin and a second solvent (poor solvent) substantially incapable of dissolving the resin and having a lower evaporation rate than the first solvent, thereby to obtain a coating liquid in the form of a solution. Preferably the second solvent has a boiling point which is higher by 15–40° C. than that of the first solvent and which is preferably 100° C. or less. Two or more good solvents and/or two or more poor solvents may be used in combination, if desired. As the proportion of the poor solvent increases, the size of the pores 3 of the resulting porous resin layer 4 tends to increase. The mixing ratio of the poor solvent to the good solvent may be determined in consideration of the desired pore size.

The thus obtained coating liquid is then applied over a surface of a thermoplastic resin film 1 to form a wet resin coating. The application of the coating liquid may be carried out by any desired coating method such as blade coating, transfer roll coating, wire bar coating, reverse roll coating or gravure coating. The wet resin coating is then heated at a temperature below the boiling point of the second solvent but sufficient to vaporize part of the first solvent so that a portion of the resin precipitates. Subsequently, the coating is further heated preferably at 60° C. or less until the coating is completely dried. During the course of the vaporization of the solvents, there are formed a multiplicity of pores.

Examples of suitable poor and good solvents are shown in Table 1 below. As shown, good and poor solvents vary with the resin to be dissolved.

TABLE 1

| Solvent | Resin | | | | | |
|---|---|---|---|---|---|---|
| (b.p. ° C.) | PVC*1 | VCA*2 | PB*3 | PS*4 | ANS*5 | ABS*6 |
| Methanol (64.5) | poor | poor | poor | poor | poor | poor |
| Ethanol (78.3) | poor | poor | poor | — | — | poor |
| Ethyl acetate (77.1) | — | good | poor | good | good | — |
| Acetone (56.1) | good | good | poor | good | good | good |
| Methyl ethyl ketone (79.6) | good | good | poor | good | good | good |
| Diethyl ether (34.5) | poor | — | — | poor | poor | poor |
| Tetrahydrofuran (65–67) | good | good | good | good | — | — |
| Hexane (68.7) | poor | poor | good | poor | poor | — |
| Heptane (98.4) | poor | poor | poor | poor | poor | poor |
| Benzene (80.1) | — | poor | good | good | good | good |
| Toluene (110.6) | — | good | good | good | good | good |
| Xylene (139.1) | — | good | good | good | good | good |
| Chloroform (61.2) | — | good | good | good | good | good |
| Carbon tetrachloride (76.7) | — | good | good | good | — | — |
| Water (100.0) | poor | poor | poor | poor | poor | poor |

| Solvent | Resin | | | | | |
|---|---|---|---|---|---|---|
| (b.p. ° C.) | MAR*7 | PVA*8 | PC*9 | AC*10 | AR*11 | VB*12 |
| Methanol (64.5) | — | good | poor | — | poor | good |
| Ethanol (78.3) | — | poor | poor | — | poor | good |
| Ethyl acetate (77.1) | good | good | poor | good | good | good |
| Acetone (56.1) | good | good | poor | good | good | good |
| Methyl ethyl ketone (79.6) | good | good | poor | good | — | good |
| Diethyl ether (34.5) | — | poor | — | — | — | poor |
| Tetrahydrofuran (65–67) | good | — | good | good | — | good |
| Hexane (68.7) | poor | poor | poor | poor | poor | poor |
| Heptane (98.4) | poor | poor | poor | poor | poor | poor |
| Benzene (80.1) | good | good | good | — | good | poor |
| Toluene (110.6) | good | good | good | poor | good | poor |
| Xylene (139.1) | good | good | good | poor | good | — |
| Chloroform (61.2) | good | good | good | good | good | — |
| Carbon tetrachloride (76.7) | — | — | good | poor | — | — |
| Water (100.0) | poor | poor | poor | poor | poor | poor |

*1PVC: poly (vinyl chloride)
*2VCA: vinyl chloridevinyl acetate copolymer
*3PB: polybutylene
*4PS: polystyrene
*5ANS: acrylonitrilestyrene copolymer
*6ABS: acrylonitrilebutadiene-styrene copolymer
*7MAR: methacrylic acid resin
*8PVA: poly(vinyl acetate)
*9PC: polycarbonate
*10AC: acetylcellulose resin
*11AR: acrylate resin
*12VB: polyvinylbutyral In a second embodiment, the porous resin layer may be prepared as follows. First, a solution of a resin for the porous resin layer in a first solvent is prepared. The solution is applied over a surface of a thermoplastic resin film to form a wet resin coating over the surface. Then, vapors or fine droplets of a second solvent substantially incapable of dissolving the resin are sprayed over the wet resin coating so that the second solvent is taken into the wet resin coating to cause a portion of the resin to precipitate. Thereafter, the resin coating is heated to dryness to form a porous resin layer. The first and second solvents are similar to those described above. In the second embodiment, the size and number of pores may be controlled by the amount and particle size of the droplets of the second solvent. It is preferred that the thermoplastic resin film be previously applied with a spray of the second solvent before being applied with the solvent solution of the resin, since the contact area between the resulting porous resin layer and the thermoplastic resin film is decreased and, therefore, the stencil can be more easily perforated by a thermal head.

In a third embodiment, a solution of a resin for the porous resin layer in a first solvent is applied over a surface of a thermoplastic resin film to form a wet resin coating over the surface. While the coated film is confined in an atmosphere of a second poor solvent, the wet coating is heated to evaporate the first solvent. Because of the heat of evaporation, the temperature of the coating is lowered so that the vapors of the second solvent are condensed and taken into the coating. As a consequence, the resin precipitates to form porous resin layer. The solvent solution of the resin to be applied to the thermoplastic film may contain a small amount of the second, poor solvent so as to obtain uniform pores. If desired, two or more of the above first to third methods may be combined for the fabrication of the porous resin layer.

As shown in FIG. 2, a thin resin layer 9 may be interposed between the porous resin layer 4 and the thermoplastic film 1. The thin resin layer 9 is substantially non-porous and is in contact with the resin film 1 substantially throughout its whole area. During perforation of the resin film 1, the thin resin layer 9 is also perforated together. Thus, the porous resin layer 4 is tightly bonded to the resin film 1 through the thin resin layer 9. Yet, the stencil has high sensitivity to thermal perforation. The above-described resins for use in the preparation of the porous resin layer 4 may be used as the resin for the thin resin layer 9.

In one, first preferred embodiment, the thin resin layer 9 forms a continuous integral body together with the porous resin layer 4 so that there is no interface between the thin resin layer 9 and the porous resin layer 4. Since the thin resin layer 9 is bonded with the resin film 1 in its whole area and is integrated with the porous resin layer 4, fully satisfactory adhesion between the porous resin layer 4 and the resin film 1 can be established. The porous resin layer 4 in this embodiment may be regarded as being a single layer having a base portion (providing the thin resin layer 9) which is in contact with the resin film 1 and which is substantially non-porous and an upper portion having a multiplicity of open pores or cells. Such a continuous layer structure may be obtained by one stage method as described hereinafter.

In another, second embodiment, the thin resin layer 9 and the porous resin layer 4 are separately formed.

In either embodiment, it is necessary that the thin resin layer 9 should be perforated when the resin film 1 is thermally perforated with, for example, a thermal head. Sensitivity to thermal perforation of the thin resin layer 9 may be controlled by selection of the kind of the resin for the thin resin layer 9 and the thickness thereof. It is preferred that the thickness of the thin resin layer 9 be in the range of 1–100% of the thickness of the resin film 1 for reasons of the sensitivity to thermal perforation and stiffness of the stencil. More preferably, the thickness of the thin resin layer 9 is in the range of 0.001 $\mu$m to 10 $\mu$m.

For reasons of improved bonding between the porous resin layer 4 and the thin resin layer 9, it is preferred that the thin resin layer 9 contain at least one resin which is used in the porous resin layer 4.

The thin resin layer 9 may be prepared as follows.

In one process, a resin for forming the porous resin layer 4 is first dissolved in a mixed solvent including a first solvent (good solvent) capable of dissolving the resin and a second solvent (poor solvent) substantially incapable of dissolving the resin, thereby to obtain a coating liquid. The first and second solvents are miscible at least in part. Preferably the first solvent has a boiling point which is lower by 15–40° C. than that of the second solvent. Examples of the good and poor solvents for resins are as described previously.

The concentration of the resin in the mixed solvent solution is generally 2–50% by weight. The weight ratio of the first solvent to the second solvent is preferably in the range of 13:1 to 20:1.

The thus obtained coating liquid is then applied over a surface of a resin film to form a wet resin coating. The application of the coating liquid may be carried out by any desired coating method such as blade coating, transfer roll coating, wire bar coating, die coating, reverse roll coating or gravure coating. The wet resin coating is then heated at a temperature below the boiling point of the second solvent but sufficient to vaporize part of the first solvent. Subsequently, the coating is further heated preferably at 80° C. or less until the coating is completely dried. During the course of the vaporization of the solvents, there are simultaneously formed a thin resin layer 9 at a region adjacent to the resin film 1 and a porous resin layer 4 having a multiplicity of open pores on the thin resin layer 9.

While not wishing to be bound by the theory, it is believed that the porous resin layer and thin non-porous resin layer are formed by the following mechanism. As the good solvent in a surface region of the wet coating evaporates, the concentration of the poor solvent increases. Thus, resin begins precipitating on nuclei. The precipitates combine and grow to form a three-dimensional matrix. Since, in a region adjacent to the resin film, the good solvent does not evaporate quickly but remains, the resin does not precipitate. As a result, when the good solvent is forced to evaporate, there is formed a substantially non-porous thin resin layer on the resin film.

In another process, a coating solution containing a resin for the thin resin layer is applied to a surface of the resin film and dried to form the thin resin layer. Next, a porous resin layer is formed on the thin resin layer by a method described above.

In a further process, a thin resin layer and a porous resin layer are simultaneously formed on a releasable surface, such as a fluorocarbon sheet, in a manner similar to the above-described process. The thus obtained material consisting of the thin resin layer and the porous resin layer is peeled and separated from the releasable surface. By bonding a resin film to the material, a stencil of the present invention can be obtained.

The adhesion between the thin resin layer and the resin film is preferably such as to provide an adhesion strength therebetween of at least 1.0 kg/cm$^2$, more preferably at least 2.0 kg/cm$^2$. The adhesion strength herein is measured as follows. A stencil is cut into a square sample of a 10 mm×10 mm size. The sample is fixed on a horizontal table using a pressure sensitive adhesive double coated tape (NITTO both sides adhesive manufactured by Nitto Tape Inc.; width 5 mm) such that the resin film of the sample faces the table. Using similar double coated adhesive tape, the top surface of the porous resin layer of the sample fixed on the table is attached to a plastic plate secured to a spring balance. The spring balance is then vertically pulled so that the porous resin layer is separated from the resin film. The force required for the separation is measured by the spring balance and represents the adhesion strength.

A total thickness of the porous resin layer and the thin resin layer is preferably 5–100 $\mu$m, more preferably 6–50 $\mu$m, for reasons of satisfactory ink retentivity in the stencil and ink transferability through the stencil. The thickness can be measured from SEM of a cross-section of the stencil. The basis weight of a total of the porous resin layer and the thin resin layer is preferably 0.5–25 g/m$^2$, more preferably 2–15 g/m$^2$, 3–10 g/m$^2$.

If desired, a stick preventing layer (overcoat layer) may be provided on a surface of the resin film for the purpose of preventing sticking between a thermal head and the stencil, so that the thermal head can smoothly run or slide on the stencil during perforation for producing a printing master from the stencil. The stick preventing layer may be a layer containing a silicone releasing agent, a fluorocarbon releasing agent or a phosphate surfactant.

Referring again to FIG. 1, an ink permeable, water soluble resin layer 8 and a fibrous porous layer 7 are provided in this order on the porous resin layer 4.

When the fibrous porous layer 7 is provided directly on the porous resin layer 4 and when the fibrous porous layer 7 is made of fibers having a relatively large diameter so as to provide a sufficient tensile strength, clear print images are not obtainable from the resulting stencil, because the thick fibers adversely affect ink permeability through the stencil. The presence of the water soluble resin layer 8 can provide space through which an ink is permeable. Thus, the stencil has high tensile strength without adversely affecting image quality.

Thus, the water soluble resin layer 8 should be ink-permeable. It is preferred that the total area of the openings of the water soluble resin layer 8 be 38–82% of a total area S of the surface of the water soluble resin layer 8 for reasons of proper ink passage therethrough while ensuring proper adhesion between the fibrous porous layer 7 and the porous resin layer 4. The total area of the openings may be measured from an electron microphotograph (magnification: 1,000) of the surface of the water soluble resin layer 8. The photograph is processed by an image processor (LA-555D manufactured by Pierce Inc.) for determining the diameter of the openings.

The water soluble resin layer 8 preferably has a thickness of 1–10 $\mu$m, for reasons of proper ink transference.

The water soluble resin used for the layer 8 may be, for example, starch, gelatin, natural rubber, casein, methyl cellulose, polyacrylic acid, sodium polyacrylate, polyacrylamide, polyvinylpyrrolidone, polyvinyl alcohol, carboxymethyl cellulose, ethyl cellulose or hydroxyethyl cellulose. The use of polyvinyl alcohol is preferred for reasons of high bonding strength.

The ink permeable, water soluble resin layer 8 may be formed from an aqueous resin solution. In order to prevent plugging of the pores of the porous resin layer 4 with the water soluble resin, it is desired that the aqueous resin solution have a high viscosity. The aqueous resin solution may be applied by coating, printing (e.g. gravure printing, flexo printing or offset printing) or spraying on a surface of one of the porous resin layer 4 or the fibrous porous layer 7. The water soluble resin layer 8 need not be continuous. Then, the layers 4 and 7 are laminated with the applied coating serving as an adhesive. An extender, pigment or filler may be incorporated into the aqueous resin solution to facilitate the formation of openings in the water soluble resin layer 8. The extender (or filler) may be, for example, barites, barium sulfate, barium carbonate, calcium carbonate, kaolin, clay, silica, hydrated silica, talc, basic magnesium carbonate, alumina white, basic lead carbonate, basic lead sulfate, lead sulfate, zinc sulfate and titanium oxide, potassium titanate, potassium borate or titanium oxide. The pigment in the form of whiskers is suitably used.

The fibrous porous layer 7 may be formed of a mineral fiber such as glass fiber, sepiolite fiber or metal fiber; an animal fiber such as wool or silk; a plant fiber such as cotton or hemp; a reclaimed fiber such as rayon or staple; a synthetic fiber such as polyester, polyvinyl alcohol or acrylate; a semi-synthetic fiber such as carbon fiber; mixed fiber thereof; or a thin paper such as inorganic fiber paper having a whisker structure. The diameter of the fiber is generally 30 $\mu$m or less, preferably 1–10 $\mu$m, for reasons of proper tensile strength and proper ink passage through the fibrous layer 2. The length of the fiber is generally 0.1–2 mm for reasons of uniformity of the fibrous layer 2. The fibrous porous layer 7 preferably has a basis weight of 1–20 g/m$^2$, more preferably 3–10 g/m$^2$, for reasons of proper ink permeability and tensile strength. The fibrous porous layer 7 may be a paper obtained by wet papermaking of short fibers such as natural fibers, synthetic fibers and mixtures thereof, a non-woven fabric, a woven fabric or a screen gauze. The fibrous porous layer 7 may be a laminate of two or more fibrous layers or may be overlaid with a porous resin layer.

In use, the stencil is heated imagewise by, for example, a thermal head to perforate the heated portions of the thermoplastic resin film, thereby obtaining a printing master for reproducing images by mimeographic printing. In this case, it is preferred that the stencil be provided with imagewise perforations each having an area of at least D $\mu$m determined by the following equation:

$$D=(61-Y)/0.0063$$

wherein Y is (AO/AS)×100% where AS represents a total area of a surface of the porous resin layer and AO represents a total area of openings of the porous resin layer exposed to the surface of the porous resin layer. Y is preferably less than 61% for reasons of prevention of backside stains.

Stated otherwise, the stencil master obtained from the heat-sensitive stencil of the present invention is preferably provided with imagewise perforations each having an area of at least D $\mu$m, wherein the porous resin layer has pores exposed to a surface thereof to form a multiplicity of openings, wherein the total area of the openings is Y% of a total area of the surface, and wherein D and Y have the following relationship:

$$D=(61-Y)/0.0063.$$

Referring to FIG. 3 in which the same reference numerals as used in FIG. 2 designate similar component parts, the present invention also provides a heat-sensitive stencil which comprises a thermoplastic resin film 1, a porous resin layer 4 provided on the thermoplastic resin film 1, a fibrous porous layer 7 provided on the porous resin layer 4, a thin resin layer 9 provided between the thermoplastic resin film 1 and the porous resin layer 4, and imagewise perforations 5 provided in the stencil and each having an area of at least D $\mu$m. The porous resin layer 4 has pores exposed to a surface thereof to form a multiplicity of openings, wherein the total area of the openings is Y% of the area of the surface, and wherein D and Y have the following relationship:

$$D=(61-Y)/0.0063.$$

Since the thermoplastic resin film 1, porous resin layer 4, fibrous porous layer 7 and thin resin layer 9 of the stencil of FIG. 3 are similar to those described above, explanation thereof is omitted here.

The above stencil printing master preferably has such perforations 5 at least 80% of which are each sparsely covered with 2–7 fibers of the fibrous porous layer 7 for reasons of proper ink passage through the stencil master, when 100 perforations are arbitrarily selected for the measurement of the number of the fibers.

The following examples will further illustrate the present invention. Parts and percentages are by weight. Softening points of resins were measured using thermal stress strain measuring apparatus TMA/SS150C (Seiko Electric Industry Co., Ltd).

EXAMPLE 1

| | |
|---|---|
| Cellulose acetate butylate (softening point: 131° C., CAB381-20 manufactured by Eastman Kodak Inc.) | 5 parts |
| Methyl ethyl ketone (b.p. 79.6° C.) | 85 parts |
| Water (b.p. 100.0° C.) | 5 parts |
| Methanol (b.p. 64.5° C.) | 5 parts |

The above composition was stirred to dissolve the resin in the solvent and allowed to quiescently stand to remove foams. The solution was then uniformly applied to a biaxially stretched polyester film (thickness: 3.5 μm) with a wire bar (diameter: 0.6 mm) at a temperature of 30° C. and a relative humidity of 50%, thereby to form a wet coating. This was allowed to stand as such for 1 minute and then placed in a drying chamber at 50° C. for 2 minutes to dry the coating. The dried coating was a porous resin layer. A liquid containing a silicone resin and a cationic antistatic agent was applied on the back side of the polyester film opposite the porous layer and dried to form a stick preventing layer having a deposition amount of 0.05 g/m$^2$.

| | |
|---|---|
| Polyvinyl alcohol resin (PVA205 manufactured by Kurare Inc., partially saponified, polymerization degree: 500, 10% aqueous solution) | 100 parts |
| Potassium titanate (Timos D manufactured by Ohtsuka Seiyaku Co., Ltd.) | 5 parts |
| Silica (FDS-2 manufactured by Shionogi Seiyaku Co., Ltd.) | 5 parts |

The above composition was dispersed with a stirrer to obtain a coating liquid. The coating liquid was applied to a surface of the fibrous porous layer with a wire bar to form an ink permeable, water soluble resin layer having a deposition amount of 10 g/m$^2$ (wet basis)

| | |
|---|---|
| Vinyl chloride-vinyl acetate copolymer (VYHH manufactured by Union Carbide Inc.) | 1 part |
| Polyester fiber (0.15 denier, diameter: 4 μm, specific gravity: 1.4, manufactured by Teijin Inc.) | 2.1 parts |
| Ethyl acetate | 8 parts |

The above composition was dispersed with a ball mill. The dispersion was coated on a polyester film having a thickness of 1.5 μm using a roll coater and dried at 50° C. to obtain a fibrous porous layer having a deposition amount of 3.5 g/cm$^2$ (on dry basis). The fibrous porous layer was peeled from the polyester film and laminated on the above ink permeable, water soluble resin layer, thereby obtaining a stencil according to the present invention.

EXAMPLE 2

| | |
|---|---|
| Cellulose acetate butylate (softening point: 131° C.) | 5 parts |
| Methyl ethyl ketone (b.p. 79.6° C.) | 60 parts |
| Water (b.p. 100.0° C.) | 30 parts |
| Methanol (b.p. 64.5° C.) | 5 parts |

Example 1 was repeated in the same manner as described except that the above composition was substituted for the composition used in Example 1 for the formation of the porous resin layer.

EXAMPLE 3

| | |
|---|---|
| Cellulose acetate butylate (softening point: 131° C.) | 5 parts |
| Methyl ethyl ketone (b.p. 79.6° C.) | 85 parts |
| Water (b.p. 100.0° C.) | 5 parts |
| Methanol (b.p. 64.5° C.) | 5 parts |

The above composition was stirred to dissolve the resin in the solvent and allowed to quiescently stand to remove foams. The solution was then uniformly applied to a biaxially stretched polyester film (thickness: 3.5 μm) with a wire bar (diameter: 0.6 mm) at a temperature of 30° C. and a relative humidity of 50%, thereby to form a wet coating. Fine droplets of water were sprayed for 15 seconds from Humidiffer UV-107D (manufactured by Hitachi Inc.) over the surface of the wet coating placed at a distance 10 cm$^2$ away from the Humidiffer. This was allowed to stand as such for 1 minute and then placed in a drying chamber at 50° C. for 2 minutes to dry the coating and to obtain a porous resin layer. On the thus obtained porous resin layer, a water soluble resin layer and a fibrous porous layer are formed in the same manner as that in Example 1.

EXAMPLE 4

| | |
|---|---|
| Vinyl chloride-vinyl acetate copolymer (VYHH manufactured by Union Carbide Inc. softening point: 78° C.) | 3 parts |
| Acetone (b.p. 56.1° C.) | 20 parts |
| Ethanol (b.p. 78.3° C.) | 8 parts |

The above composition was stirred to dissolve the resin in the solvent and allowed to quiescently stand to remove foams. The solution was then uniformly applied to a biaxially stretched polyester film (thickness: 3.5 μm) with a wire bar (diameter: 1.0 mm) at a temperature of 20° C. and a relative humidity of 50%, thereby to form a wet coating. This was placed in a drying chamber at 50° C. for 2 minutes to dry the coating. The dried coating was a porous layer. On the thus obtained porous resin layer, a water soluble resin layer and a fibrous porous layer are formed in the same manner as that in Example 1.

EXAMPLE 5

Example 4 was repeated in the same manner as described except that a biaxially stretched polyester film (thickness: 1.5 μm) was substituted for the 3.5 μm thick biaxially stretched polyester film.

EXAMPLE 6

| | |
|---|---|
| Vinyl chloride-vinyl acetate copolymer (VAGD manufactured by Union Carbide Inc.) softening point: 83° C.) | 3 parts |
| Methyl ethyl ketone (b.p. 79.6° C.) | 17 parts |
| Methanol (b.p. 64.5° C.) | 9 parts |

Example 4 was repeated in the same manner as described except that the above composition was substituted for the composition used in Example 4 for the preparation of the porous resin layer.

EXAMPLE 7

| | |
|---|---|
| Cellulose acetate butylate (softening point: 131° C.) | 3 parts |
| Acetone (b.p. 56.1° C.) | 18 parts |
| Water (b.p. 100.0° C.) | 5 parts |
| Silica powder | 0.3 part |

Example 4 was repeated in the same manner as described except that the above composition was substituted for the composition used in Example 4 for the preparation of the porous resin layer.

EXAMPLE 8

| | |
|---|---|
| Poly(vinyl butyral) (PVB3000-2 manufactured by Denki Kagaku Kogyo K. K., softening point: 87° C.) | 8 parts |
| Ethanol (b.p. 78.3° C.) | 69 parts |
| Water (b.p. 100.0° C.) | 23 parts |
| Acrylic acid-styrene copolymer (softening point: 65° C., J679 manufactured by Johnson Polymer Inc.) | 1.2 part |

The above composition was dissolved with stirring and mixed and dispersed with 1.6 parts titanium oxide (rutile) using a ball mill. Example 4 was then repeated in the same manner as described except that the above dispersion was substituted for the composition used in Example 4 for the preparation of the porous resin layer.

COMPARATIVE EXAMPLE 1

Example 2 was repeated in the same manner as described except that neither the water soluble resin layer nor the fibrous porous layer was formed.

COMPARATIVE EXAMPLE 2

In the same manner as described in Example 2, a porous resin layer was formed on a polyester film. Then, a fibrous porous layer was formed on the porous resin layer as follows.

| | |
|---|---|
| Vinyl chloride-vinyl acetate copolymer (VYHH manufactured by Union Carbide Inc. softening point: 78° C.) | 1 part |
| Polyester fiber (0.15 denier, diameter: 4 μm, | 2.1 parts |

-continued

| | |
|---|---|
| specific gravity: 1.4, manufactured by Teijin Inc.) | |
| Ethyl acetate | 8 parts |

The above composition was dispersed with a ball mill. The dispersion was coated on a polyester film having a thickness of 1.5 μm using a roll coater and dried at 50° C. to obtain a fibrous porous layer having a deposition amount of 3.5 g/cm$^2$ (on dry basis). The fibrous porous layer was peeled from the polyester film and laminated on the porous resin layer thereby obtaining a comparative stencil having no water soluble resin layer.

Each of the thus obtained heat-sensitive stencils was measured for average pore diameter of the porous resin layer, density of the porous resin layer, open degree OD1 (which is defined as a percentage of a total area of the openings of the porous resin layer having an equivalent diameter of at least 5 μm based on a total area of the surface of the porous resin layer), open degree OD2 (which is defined as a percentage of a total area of the openings of the porous resin layer having an equivalent diameter of at least 5 μm based on a total area of the openings of the porous resin layer), bonding strength, flexural rigidity, perforation sensitivity, elongation, print quality, backside stains and print density. The average pore diameter, open degree OD1, open degree OD2 and flexural rigidity were measured by the methods described previously.

The bonding strength, perforation sensitivity, elongation, print quality, backside stains and print density were measured using PRIPORT VT 3820 (manufactured by Ricoh Company Ltd.; provided with a thermal head manufactured by Toshiba Inc.).

The bonding strength between the thermoplastic resin film and the porous resin layer is measured by perforating a sample stencil with a thermal head to see whether or not the support is separated from the thermoplastic resin film. Evaluation is made according to the following ratings:

A: no separation

B: slight separation

C: significant separation

The perforation sensitivity was evaluated according to the following ratings:

A: all perforations are properly formed

B: part of perforations have small diameters

C: perforations are partly failed

D: most of perforations are failed

The elongation of the stencil was measured after 300 prints had been produced and evaluated by the following ratings:

A: no elongation of the stencil is found

B: elongation of the stencil is found

The print image quality was evaluated with respect to blurs and variation of density. Evaluation was made by comparison with the image obtained using a commercial stencil (VT2 Master manufactured by Ricoh Company Ltd.) and rated as follows:

A: better

B: comparable

C: inferior

The backside stain (offset) is an undesirable phenomenon of transference of an ink in a stacked prints from one print to adjacent print. Evaluation was made by comparison with the image obtained using a commercial stencil (VT2 Master manufactured by Ricoh Company Ltd.) and rated as follows:

A: better

B: comparable

C: inferior

The print density of the 20th print from the initiation of printing was measured using McBeath densimeter RD914.

The results are summarized in Table 2.

TABLE 2

| | Porous Resin Layer | | | | Stencil | |
|---|---|---|---|---|---|---|
| Example | Average pore diameter (μm) | Density (g/cm³) | Open degree OD1 (%) | Open degree OD2 (%) | Thickness (μm) | Flexural Rigidity (mN) |
| 1 | 10 | 0.8 | 60 | 93 | 43 | 133 |
| 2 | 12 | 0.5 | 65 | 96 | 45 | 137 |
| 3 | 15 | 0.6 | 75 | 98 | 46 | 142 |
| 4 | 8 | 0.3 | 40 | 93 | 52 | 127 |
| 5 | 8 | 0.3 | 40 | 93 | 50 | 129 |
| 6 | 18 | 0.5 | 38 | 95 | 53 | 138 |
| 7 | 1.7 | 0.5 | 7 | 51 | 42 | 128 |
| 8 | 3.2 | 0.7 | 12 | 80 | 48 | 134 |
| Comp. 1 | 12 | 0.5 | 65 | 96 | 12 | 11 |
| Comp. 2 | 12 | 0.5 | 65 | 96 | 42 | 72 |

| | Stencil | | | Properties of Print | | |
|---|---|---|---|---|---|---|
| Example | Bonding strength | Perforation sensitivity | Elongation | Image quality | Backside Stains | Image density |
| 1 | B | B | B | B | B | 0.97 |
| 2 | B | A | A | A | A | 1.05 |
| 3 | B | A | A | B | B | 1.01 |
| 4 | B | A | A | A | A | 1.12 |
| 5 | B | A | A | A | A | 1.22 |
| 6 | B | A | A | A | A | 1.08 |
| 7 | B | B | A | B | A | 0.81 |
| 8 | B | A | A | A | A | 1.10 |
| Comp. 1 | B | A | D | A | A | 1.05 |
| Comp. 2 | B | A | A | D | A | 1.05 |

EXAMPLE 9

| | |
|---|---|
| Poly(vinyl butyral) (PVB3000-2 manufactured by Denki Kagaku Kogyo K. K., softening point: 87° C.) | 4 parts |
| Ethanol (b.p. 78.3° C.) | 35.5 parts |
| Water (b.p. 100.0° C.) | 11.5 parts |

Figure 5:
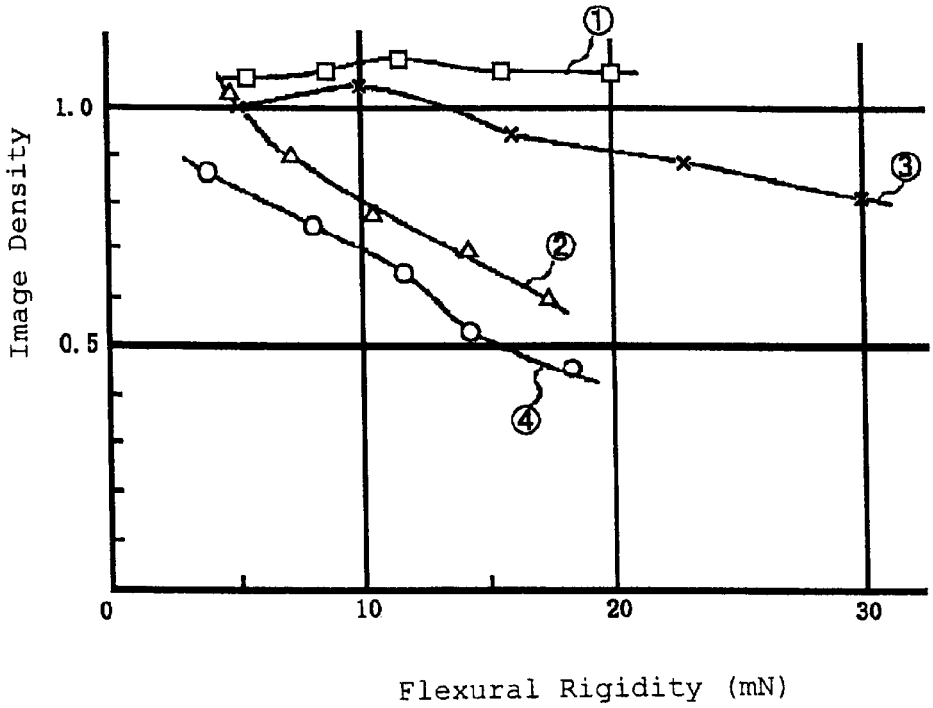
FIG. 5 is a graph showing a relationship between image density and flexural rigidity of heat-sensitive stencils according to the present invention.

The above composition was dissolved with stirring and mixed and dispersed with 0.8 part of needle-like magnesium silicate using a ball mill. The dispersion was then uniformly applied to a biaxially stretched polyester film (thickness: 3.5 μm) with a wire bar (diameter: 0.6 mm) to form a wet coating. This was immediately placed in a drying chamber at 50° C. for 3 minutes to dry the coating and to obtain a porous resin layer. On the thus obtained porous resin layer, a water soluble resin layer and a fibrous porous layer are formed in the same manner as that in Example 1. The thus obtained stencil had an air permeability of 62 $cm^3/cm^2$·sec. The above procedures were repeated in the same manner as described except that various wire bars having diameters of 0.8 mm, 1.0 mm, 1.2 mm and 1.4 mm were used in place of the 0.6 mm wire bar, thereby obtaining stencils having air permeability (measured by the method described above) of 57, 53, 48 and 39 $cm^3/cm^2$·sec, respectively. Each of the stencils was found to have an open degree OD1 in the range of 35–43% and to give prints having high image density and free of backside stains. The relationship between the flexural rigidity and the image density of the above stencils is shown by the curve ① in FIG. 5.

EXAMPLE 10

| | |
|---|---|
| Poly(vinyl butyral) (PVB3000-2 manufactured by Denki Kagaku Kogyo K. K., softening point: 87° C.) | 4 parts |
| Ethanol (b.p. 78.3° C.) | 35.5 parts |
| Water (b.p. 100.0° C.) | 1.5 parts |

Using the above composition, a porous resin layer was formed in the same manner as described in Example 4. On the thus obtained porous resin layer, a water soluble resin layer and a fibrous porous layer were formed in the same manner as that in Example 4. The above procedures were repeated using various wire bars, thereby obtaining stencils having air permeability of 31, 26, 21 and 17 $cm^3/cm^2$·sec. Each of the stencils was found to have an open degree OD1 in the range of 33–40%. The relationship between the flexural rigidity and the image density of the above stencils is shown by the curve ② in FIG. 5. As seen from the comparison of curves ① and ②, the image density of the stencils containing a filler in the porous resin layer remains unchanged when the flexural rigidity increases (curve ①). In the absence of the filler, the image density decreases with an increase of the rigidity (curve ②) because of a decrease of the air permeability.

EXAMPLE 11

| | |
|---|---|
| Poly (vinyl acetal) | 2 parts |
| Ethanol | 18 parts |
| Water | 3 parts |

The above composition was dissolved with stirring and mixed and dispersed with 0.4 part of plate-like magnesium silicate (talc, Microace P4 manufactured by Nippon Talc Inc.) using a ball mill. The dispersion was then uniformly applied to a biaxially stretched polyester film (thickness: 1.5 μm) with a wire bar to form a wet coating. This was immediately placed in a drying chamber at 50° C. for 3 minutes to dry the coating and to obtain a porous resin layer. On the thus obtained porous resin layer, a water soluble resin layer and a fibrous porous layer were formed in the same manner as that in Example 1. The above procedures were repeated using wire bars having various diameters, thereby obtaining stencils having air permeability of 60, 56, 54, 46 and 37 $cm^3/cm^2$·sec. Each of the stencils was found to have an open degree OD1 in the range of 65–76%. The relationship between the flexural rigidity and the image density of the above stencils is shown by the curve ③ in FIG. 5.

EXAMPLE 12

| | |
|---|---|
| Poly (vinyl acetal) | 2 parts |
| Ethanol | 18 parts |
| Water | 3 parts |

Using the above composition, a porous resin layer was formed in the same manner as described in Example 4. On the thus obtained porous resin layer, a water soluble resin layer and a fibrous porous layer were formed in the same manner as that in Example 1. The above procedures were repeated using wire bars having various diameters, thereby obtaining stencils having air permeability of 54, 39, 28, 19 and 12 $cm^3/cm^2 \cdot sec$. Each of the stencils was found to have an open degree OD1 in the range of 61–72%. The relationship between the flexural rigidity and the image density of the above stencils is shown by the curve ④ in FIG. 5. As seen from the comparison of curves ③ and ④, the image density of the stencils containing a filler in the porous resin layer remains unchanged when the flexural rigidity increases (curve ③). In the absence of the filler, the image density decreases with an increase of the rigidity (curve ④) because of a decrease of the air permeability.

EXAMPLE 13

Polycarbonate (2 parts) was dissolved in a mixed solvent containing 28 parts of tetrahydrofran and 3.8 parts of ethanol, to which 1.1 parts of polyvinyl butyral (serving as an adhesion improver for a porous resin layer and a thermoplastic resin film) was further dissolved. 5 parts of potassium titanate whiskers (Tofica Y manufactured by Otsuka Seiyaku Co., Ltd.) were then dispersed into the above resin solution using a ball mill to obtain a coating liquid. The coating liquid was then uniformly applied to a biaxially stretched polyester film (thickness: 3.5 $\mu$m) with a wire bar (diameter: 1.0 mm) and the wet coating was dried to form a porous resin layer. A water soluble resin layer and a fibrous porous layer were then formed on the thus obtained porous resin layer in the same manner as that in Example 1. The porous resin layer of the thus obtained stencil had an open degree OD1 of 44%. The stencil had an air permeability of 142 $cm^3/cm^2 \cdot sec$, a flexural rigidity of 110 mN and gave prints having an image density of 1.05 and no backside stains.

EXAMPLES 14–19

| | |
|---|---|
| Polyvinyl acetal resin (Eslek KS-1 manufactured by Sekisui Kagaku Kogyo Co., Ltd.) | 3.2 parts |
| Talc (Microace L-G manufactured by Nippon talc Inc.) | 2.4 parts |
| Sorbitan tatty acid ester (SO-10 manufactured by Nikko Chemicals Inc.) | 0.1 part |
| Modified silicone oil (KF6012 manutactured by Shinetsu Kagaku Kogyo Co., Ltd.) | 0.1 part |
| Acrylic polymer o/w emulsion (Joncryl-711 manufactured by Johnson Polymer Inc.) | 0.2 part |

The above composition was dissolved and dispersed in ethyl acetate, to which 1% aqueous solution of hydroxyethyl cellulose was added in an amount one part per 1.5 parts of the ethyl acetate to form a coating liquid. The amount of the ethyl acetate was varied so as to provide 6 kinds of the coating liquids having various solid matter contents and viscosities as shown in Table 3. Each of the coating liquids was applied to a biaxially stretched polyester film (thickness: 2 $\mu$m) with a die head at 20° C. and a relative humidity of 50% to form a wet coating. This was then placed in a drying chamber at 50° C. and a relative humidity of 50% to dry the coating and to simultaneously obtain a porous resin layer and a thin resin layer having a total deposition amount of 6 $g/m^2$. The thin resin layer had a thickness of about 0.4 $\mu$m. The porous resin layer was measured for its total area of openings. On the thus obtained porous resin layer, a water soluble resin layer and a fibrous porous layer were formed in the same manner as that in Example 1.

| | |
|---|---|
| Silicone oil (SF8422 manufactured by Shinetsu Kagaku Kogyo Co., Ltd.) | 0.5 part |
| Surfactant (Plysurf A208 manufactured by Daiichi Kogyo Seiyaku Inc.) | 0.5 part |
| Toluene | 100 parts |

The liquid containing a silicone resin and a cationic antistatic agent was applied on the back side of the polyester film opposite the porous resin layer of each of the 6 stencils and dried to form a stick preventing layer having a deposition amount of 0.05 $g/m^2$.

The resulting stencils were then perforated to form masters and tested for printing quality using 3 printers giving different area (D $\mu m^2$) of perforations, i.e. PRIPORT JP1300 (manufactured by Ricoh Company Ltd.; perforation area D: 3700 $\mu m^2$), JP5050 (manufactured by Ricoh Company Ltd.; perforation area D: 2400 $\mu m^2$) and VT6000 (manufactured by Ricoh Company Ltd.; perforation area D: 300 $\mu m^2$). The image quality of the 10th print from the initiation of printing was evaluated with respect to white spots according to the following ratings:

A: no white spots (excellent quality)

B: slight white spots (no good)

C: significant white spots (bad)

The results are summarized in Table 3.

TABLE 3

| Example | Coating Liquid: Solid Matter Content (%) | Coating Liquid: Viscosity (cP) | Porous Resin Layer: Degree of Opening Y (%) | Image Quality: D = 3700 JP1300 | Image Quality: D = 2400 JP5050 | Image Quality: D = 300 VT6000 |
|---|---|---|---|---|---|---|
| 14 | 4.0 | 50 | 82 | A | A | A |
| 15 | 4.5 | 100 | 67 | A | A | A |
| 16 | 5.0 | 200 | 58 | A | A | A |
| 17 | 6.0 | 500 | 46 | A | A | B |
| 18 | 7.5 | 500 | 39 | A | B | B |
| 19 | 10.0 | 1500 | 27 | B | B | B |

Table 3

The degree of opening Y and the diameter of each perforation D are measured as follows.

Degree of Opening Y (%):

Degree of opening Y is a percentage of a total area of the openings at a surface of the porous resin layer based on the area of the surface. The total area of the openings may be measured as follows. A photomicrograph of a sample stencil is taken from the thermoplastic resin film side using a photomicroscope (OLYMPUS BX60 manufactured by Olympus Corporation, magnification ×200, irradiation with a reflected light, level: 9, with use of a deflection filter, focused on the porous resin layer) and is converted into a computer image. The image is binarized using an image processing software "WinROOF" (manufactured by Mitsutani Shoji Co., Ltd.) by converting the image into gray image, converting the concentration (default), automatic binarization (P tile method, default), filling, deletion (less than 100) and measurement (shape characteristics, area). The photomicrograph is taken before the water soluble resin layer and the fibrous porous layer are laminated on the porous resin layer.

Area of Perforation:

The area of an opening may be measured as follows. A photomicrograph of a sample perforated stencil is taken using a photomicroscope (OLYMPUS BX60 manufactured by Olympus Corporation, magnification ×200, irradiation with a reflected light, level: 9, with use of a deflection filter, focused on the porous resin layer) and is converted into a computer image. The image is binarized using an image processing software "WinROOF" (manufactured by Mitsutani Shoji Co., Ltd.) by converting the image into gray image, converting the concentration (default), automatic binarization (P tile method, default), filling, deletion (less than 500) and measurement (shape characteristics, area).

EXAMPLES 20–25

Examples 14–19 were repeated in the same manner as described except that the water soluble resin layer was not formed. Substantially the same results as those in Table 3 were obtained.

EXAMPLE 26

In 33.6 parts of methanol, 4 parts of poly(vinyl butyral) (PVB4000-1 manufactured by Denki Kagaku Kogyo K. K.) were dissolved, to which 2.2 parts of water were slowly added with stirring to obtain a slightly cloudy coating liquid. The coating liquid was uniformly applied to a biaxially stretched polyester film (thickness: 2.0 $\mu$m) with a wire bar at a temperature of 20° C. and a relative humidity of 50%, thereby to form a wet coating having a deposition amount of 7.0 g/m$^2$. This was placed in a drying chamber at 50° C. for 3 minute to dry the coating and to obtain a laminate having a thin, non-porous poly(vinyl butyral) layer and a porous poly(vinyl butyral) layer continuously formed on the polyester film. The porous poly(vinyl butyral) layer was peeled from the polyester film using an adhesive tape. SEM of an exposed surface of the porous layer revealed the presence of the thin, non-porous poly(vinyl butyral) layer located in the interface between the polyester film and the porous poly (vinyl butyral) layer. The formation of the thin, non-porous resin layer was also confirmed by the following test. The removed porous layer was placed on a paper and an ink was applied on the porous layer. It was found that the ink was prevented from arriving at the paper. SEM of a cut surface of the laminate revealed that the thin poly(vinyl butyral) layer had a thickness of about 0.4 $\mu$m.

A liquid containing a silicone resin and a cationic antistatic agent (DSK Erenon No. 19M manufactured by Daiichi Kogyo Seiyaku Co., Ltd.) was applied on the back side of the polyester film opposite the porous layer and dried to form a stick preventing layer (overcoat layer) with a deposition amount of 0.05/m$^2$.

EXAMPLE 27

In 33.6 parts of methanol, 4 parts of poly(vinyl butyral) (PVB4000-1 manufactured by Denki Kagaku Kogyo K. K.) and 0.8 part of whiskers of potassium titanate (TOFIKA Y manufactured by Ootsuka Chemical Inc.) were mixed using a ball mill, to which 2.3 parts of water were slowly added with stirring to obtain a slightly cloudy coating liquid. Using this coating liquid, the procedures of Example 26 were repeated in the same manner as described to obtain a heat-sensitive stencil having a stick preventing layer. A thin, non-porous poly(vinyl butyral) layer having a thickness of about 0.4 $\mu$m was found to be formed. Further, a water soluble resin layer and a fibrous porous resin layer were laminated in the same manner as described in Example 1 to obtain a stencil according to the present invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all the changes which come within the meaning and range of equivalency of the claims are therefore intended to be embraced therein.

What is claimed is:

1. A heat-sensitive stencil comprising:

a thermoplastic resin film, a porous resin layer provided on said thermoplastic resin film, an ink permeable, water soluble resin layer provided on said porous resin layer, and a fibrous porous layer provided on said water soluble resin layer.

2. A heat-sensitive stencil as set forth in claim 1, wherein said water soluble resin layer contains an extender.

3. A heat-sensitive stencil as set forth in claim 1, wherein a thin resin layer is provided between said thermoplastic resin film and said porous resin layer.

4. A heat-sensitive stencil as set forth in claim 3, wherein said thin resin layer has at least one resin component which is the same as that of said porous resin layer.

5. A heat-sensitive stencil as set forth in claim 1, wherein said porous resin layer contains a filler.

6. A heat-sensitive stencil as set forth in claim 1, wherein said porous resin layer has pores exposed to a surface thereof to form a multiplicity of openings, and wherein the total area of said openings having an equivalent diameter of at least 5 $\mu$m is 4–80% of the area of said surface of said porous resin layer, said equivalent diameter being defined as a diameter of a circle having the same area as that of the corresponding opening.

7. A heat-sensitive stencil as set forth in claim 1, wherein said porous resin layer has pores exposed to a surface thereof to form a multiplicity of openings, wherein the total area of said openings having an equivalent diameter of at least 5 $\mu$m is at least 50% of a total area of said openings, said equivalent diameter being defined as a diameter of a circle having the same area as that of the corresponding opening.

8. A heat-sensitive stencil as set forth in claim 1, and providing air permeability of 1.0 cm$^3$/cm$^2$·sec to 157 cm$^3$/cm$^2$·sec, when perforated to have an open ratio of at least 20%.

9. A heat-sensitive stencil as set forth in claim 1, and provided with imagewise perforations each having an area of at least D $\mu$m, wherein said porous resin layer has pores exposed to a surface thereof to form a multiplicity of openings, wherein the total area of said openings is Y% of a total area of said surface, and wherein D and Y have the following relationship:

$$D=(61-Y)/0.0063.$$

10. A method of preparing a printing master, comprising perforating a heat-sensitive stencil as set forth in claim 1 with part of said porous resin layer in each perforation remaining unremoved and covering the perforation.

11. A stencil printer having a stencil as set forth in claim 1.

12. A heat-sensitive stencil comprising:

a thermoplastic resin film, a porous resin layer provided on said thermoplastic resin film, a fibrous porous layer provided on said porous resin layer, a thin resin layer provided between said thermoplastic resin film and said porous resin layer, and imagewise perforations provided in said stencil and each having an area of at least D $\mu$m, wherein said porous resin layer has pores exposed to a surface thereof to form a multiplicity of openings, wherein the total area of said openings is Y% of the area of said surface, and wherein D and Y have the following relationship:

$$D=(61-Y)/0.0063.$$

13. A heat-sensitive stencil as set forth in claim 12, wherein said porous resin layer is a layer formed by applying a resin solution obtained by dissolving a resin in a plurality of solvents having different solubility.

14. A heat-sensitive stencil as set forth in claim 12, wherein said thin resin layer has at least one resin component which is the same as that of said porous resin layer.

15. A heat-sensitive stencil as set forth in claim 12, wherein said thin resin layer and said porous resin layer form a continuous unitary body.

16. A heat-sensitive stencil as set forth in claim 12, wherein each of said perforations extends through said thermoplastic resin film and said thin resin layer.

17. A heat-sensitive stencil as set forth in claim 12, and providing air permeability of 2.0 $cm^3/cm^2 \cdot sec$ to 160 $cm^3/cm^2 \cdot sec$, when perforated to have an open ratio of at least 20%.

18. A heat-sensitive stencil as set forth in claim 12, wherein said fibrous porous layer is formed from two or more superimposed fiber layers.

19. A stencil printer having a stencil as set forth in claim 12.

* * * * *